US008237647B2

(12) United States Patent
Hosaka

(10) Patent No.: US 8,237,647 B2
(45) Date of Patent: Aug. 7, 2012

(54) DRIVING METHOD FOR LIQUID CRYSTAL DISPLAY APPARATUS, LIQUID CRYSTAL DISPLAY APPARATUS, AND ELECTRONIC DEVICE

(75) Inventor: Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 372 days.

(21) Appl. No.: 12/704,970

(22) Filed: Feb. 12, 2010

(65) Prior Publication Data

US 2010/0207966 A1 Aug. 19, 2010

(30) Foreign Application Priority Data

Feb. 17, 2009 (JP) ..... 2009-033606

(51) Int. Cl.
*G09G 3/36* (2006.01)

(52) U.S. Cl. ..... 345/96; 345/87

(58) Field of Classification Search ..... 345/87, 345/89, 96, 98, 100, 692
See application file for complete search history.

(56) References Cited

FOREIGN PATENT DOCUMENTS

JP 2005-352457 12/2005

*Primary Examiner* — Ricardo L Osorio
(74) *Attorney, Agent, or Firm* — Maschoff Gilmore & Israelsen

(57) ABSTRACT

A driving method for a liquid crystal display apparatus, a liquid crystal layer sandwiched between a pixel electrode and a counter electrode, and that controls a transmitted light in the liquid crystal layer by dividing a single frame period into multiple subfield periods and applying an on/off binary data signal between the pixel electrode and the counter electrode in each subfield period. When a counter electrode potential applied to the counter electrode is used as a reference and a voltage higher than the reference is taken as a positive-polarity voltage and a voltage lower than the reference is taken as a negative-polarity voltage, the data signal is converted to the positive-polarity voltage and negative-polarity voltage alternately and cyclically every a cyclical period having subfield period or every several subfield periods. Further, the length of half the cyclical period is no less than 1.6 ms.

6 Claims, 7 Drawing Sheets

DRIVING METHOD FOR LIQUID CRYSTAL DISPLAY APPARATUS, LIQUID CRYSTAL DISPLAY APPARATUS, AND ELECTRONIC DEVICE

BACKGROUND

1. Technical Field

The present invention relates to a driving method for a liquid crystal display apparatus, a liquid crystal display apparatus, and an electronic device.

2. Related Art

Active matrix liquid crystal display apparatuses using liquid crystals are known. The driving methods for such past active matrix liquid crystal display apparatuses can be roughly divided into an analog driving method and a digital driving method.

With the analog driving method, analog voltages are applied to pixels within a frame, and tones are expressed through the orientation states of the liquid crystals resulting from the applied voltages. Meanwhile, frame-inversion driving system, in which the polarity inversion cycle is completed with each frame write, is generally used, with a cycle of 60 Hz or, with the recent double-speed intermediate frame technology, 120 Hz being the mainstream driving rates.

On the other hand, with the digital driving method, each frame in an image signal is configured of multiple subfields (SFs) shorter than a single frame period, and the display is driven by selectively controlling each subfield to turn on or off.

For example, JP-A-2005-352457 discloses a liquid crystal display apparatus in which the subfield period in each subfield is divided into a former half and a latter half, and the positive/negative polarity of the voltage applied to the liquid crystals is inverted thereby, thus achieving AC driving (inverted driving).

JP-A-2005-352457 submits that this driving method makes it possible to suppress the cancellation of DC components applied to the liquid crystals, which causes the image problem known as flicker, and to suppress degradation of the liquid crystal material caused by the application of DC voltage. The digital driving method has thus been able to accelerate the polarity inversion cycle beyond that of the analog driving method.

It is also known that in liquid crystal display apparatuses, impurity ions are produced within the panel due to manufacturing issues, temporal change of the liquid crystals, and so on. If the produced impurity ions are adsorbed onto the alignment layer (on the substrate side) or the like, display deficiencies such as drops in contrast, luminance variance due to differences in the distribution of the adsorbed impurity ions, and so on will arise.

To be more specific, depending on their polarities, the impurity ions are adsorbed onto sides of the substrate (alignment layer, electrode, or the like) based on differences in potential caused by the voltages applied to each pixel, and a reverse electric field relative to the applied voltages is formed by the adsorbed impurity ions. To rephrase, a reverse electric field of the direction that weakens the applied voltages is formed by the adsorbed impurity ions. The situations in which this reverse electric field occurs differ depending on the resistance of the liquid crystals as well, and while it is possible to suppress changes in the potential within the frame period by using high-resistance liquid crystals, changes in potential occur within the frame period in panels that have seen extended use, panels having low resistances due to their specifications, and so on, and thus the problem of display deficiencies occurring has persisted.

However, in the past analog driving method, the aforementioned polarity inversion is slow as being a single frame unit, and the influence of voltage asymmetry is great to affect the liquid crystal. This accelerates the liquid crystal degradation, leading in turn to increased production of impurity ions, which results in the problem of impurity ions adsorption.

On the other hand, with the digital driving method, the polarity inversion cycle is too fast, and thus the liquid crystal response involved with the polarity inversion cannot keep pace, which means that polarity inversion cannot be carried out to the fullest extent; this causes a problem in that it is difficult to suppress the adsorption of impurity ions. To be more specific, a liquid crystal response time of approximately 2 ms is generally considered to be fast, but JP-A-2005-352457 discloses a minimum SF period of 5 μs and a maximum SF period of 300 μs, and thus the liquid crystal response cannot keep pace even if the positive-negative polarity is reversed in half of such a cycle.

In other words, with the past driving methods, it has been difficult to suppress display deficiencies caused by impurity ions, and thus there has been demand for a driving method that is effective against such voltage asymmetry.

SUMMARY

The invention is to provide a solution to improve at least a part of the above problems, and advantages of some aspects of the invention are as follows.

ASPECTS OF THE INVENTION

An aspect of the invention provides driving method for a liquid crystal display apparatus that includes a liquid crystal panel having a switching element and a pixel electrode provided corresponding to an intersecting point between a scanning line and a data line, a counter electrode provided facing the pixel electrode, and a liquid crystal layer sandwiched between the pixel electrode and the counter electrode, and that controls the transmitted light in the liquid crystal layer by dividing a single frame period into multiple subfield periods and applying an on/off binary data signal between the pixel electrode and the counter electrode in each subfield period. When a counter electrode potential applied to the counter electrode is used as a reference and a voltage higher than the reference is taken as a positive-polarity voltage and a voltage lower than the reference is taken as a negative-polarity voltage, the data signal is converted to the positive-polarity voltage and negative-polarity voltage alternately and cyclically every a cyclical period having subfield period or every several subfield periods. Further, the length of half the cyclical period is no less than 1.6 ms.

The inventors arrived at this aspect by repeating inventive ideas based upon experimental data obtained through various repeated experiments and knowledge derived from that experimental data. According to the results of this experimental data, the effect of suppressing the adsorption of impurity ions was achieved through subfield driving in which polarity inversion was executed for two cycles or more within a single frame. These effects were particularly evident by performing the inversion for four cycles (four instances of 4.17 ms) within a single frame; however, the same could not be said for cases exceeding five cycles (five instances of 3.33 ms). This is due to the aforementioned liquid crystal response time, and the inventors anticipated that the adsorption of impurity ions could be suppressed by limiting the period length of a half-cycle to near or more than the time in which liquid crystals are able to respond (approximately 2 ms). The experimental data confirmed the impurity ion adsorption suppression effects up to five cycles. This is thought to be because while the half-cycle period length (1.67 ms) is insufficient for the liquid crystal response time, it is near that response time, and thus the liquid crystals can essentially keep pace up to this period length.

According to this driving method, polarity inversion is performed cyclically at a faster cycle than the image frame rate and within a range in which the liquid crystals can respond, and thus the symmetry of the applied positive-polarity and negative-polarity voltages can be optimized better than in the past. To rephrase, according to this driving method, by making the period length of the half-cycle near or greater than the liquid crystal response time, the adsorption of impurity ions can be suppressed more than with past driving methods, in which the polarity inversion cycle has been too short relative to the liquid crystal response time.

Thus the symmetry of the voltages applied to the liquid crystal layer can be improved, making it possible to suppress the image problem known as flicker and suppress degradation in the liquid crystal material due to the application of DC voltages. In other words, it is possible not only to suppress the production of impurity ions, but also to reduce the adsorption of impurity ions.

Accordingly, with this driving method, it is possible to suppress display deficiencies caused by impurity ions.

Meanwhile, it is preferable for the length of half the cyclical period to be no less than 1.6 ms and no more than 4.2 ms.

Furthermore, it is preferable for the subfield periods within a single frame period to not all be the same, and for subfield periods of different lengths to be contained in the frame period.

Another aspect of the invention provides a liquid crystal display apparatus including a liquid crystal panel having a switching element and a pixel electrode provided corresponding to an intersecting point between a scanning line and a data line, a counter electrode provided facing the pixel electrode, and a liquid crystal layer sandwiched between the pixel electrode and the counter electrode, the apparatus controlling the transmitted light in the liquid crystal layer by dividing a single frame period into multiple subfield periods and applying an on/off binary data signal between the pixel electrode and the counter electrode in each subfield period. When a counter electrode potential applied to the counter electrode is used as a reference and a voltage higher than the reference is taken as a positive-polarity voltage and a voltage lower than the reference is taken as a negative-polarity voltage, the data signal is converted to the positive-polarity voltage and negative-polarity voltage alternately and cyclically every a cyclical period having subfield period or every several subfield periods, and the length of half the cyclical period is no less than 1.6 ms. Meanwhile, it is preferable for the length of half the cyclical period to be no less than 1.6 ms and no more than 4.2 ms.

An electronic device according to another aspect of the invention includes the stated liquid crystal display apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, specific working examples and embodiments of the invention will be described based on the drawings.

First Embodiment

Figure 1:
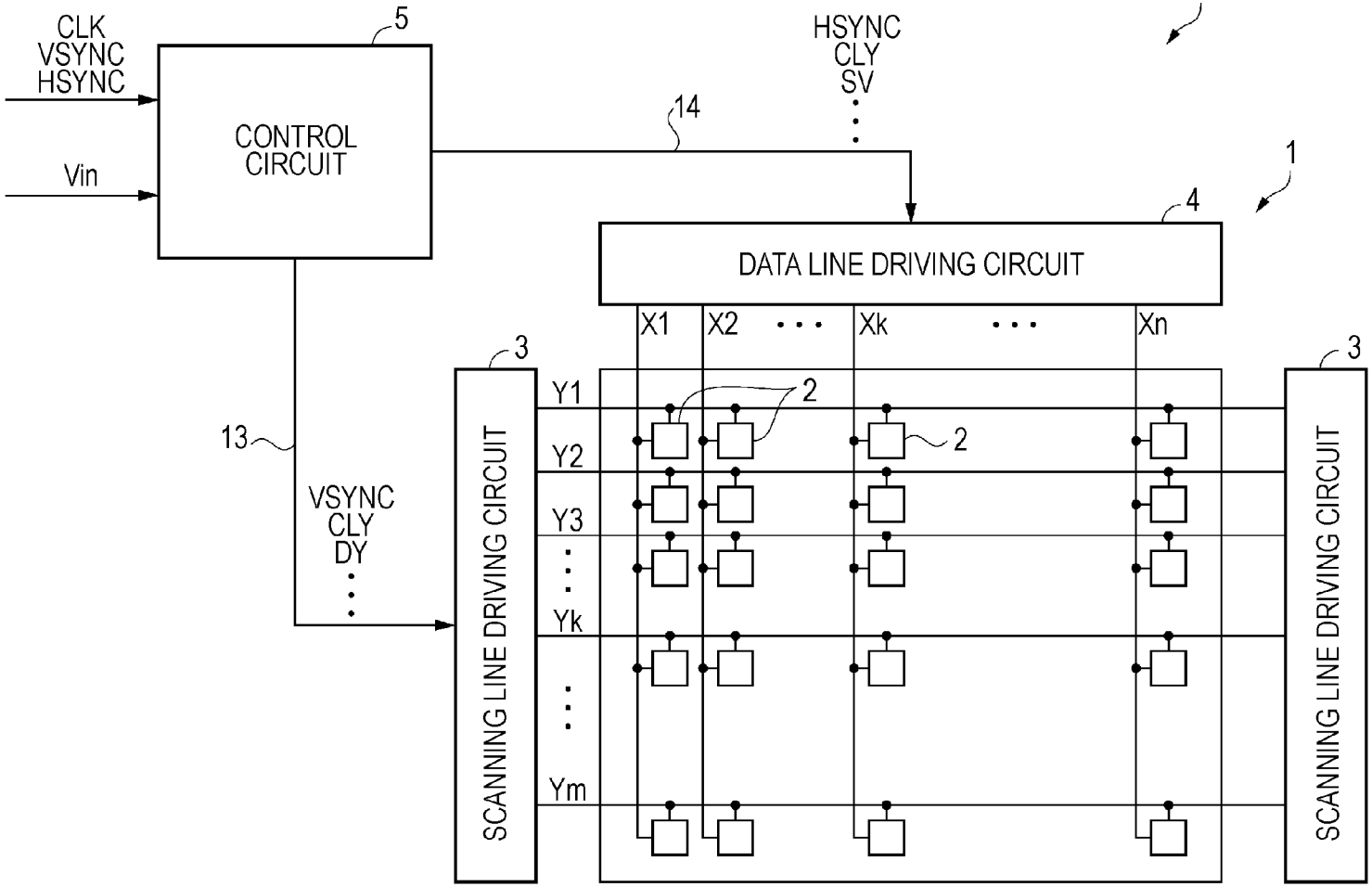
FIG. 1 is a circuit diagram of a liquid crystal display apparatus according to a first embodiment.
Figure 2:
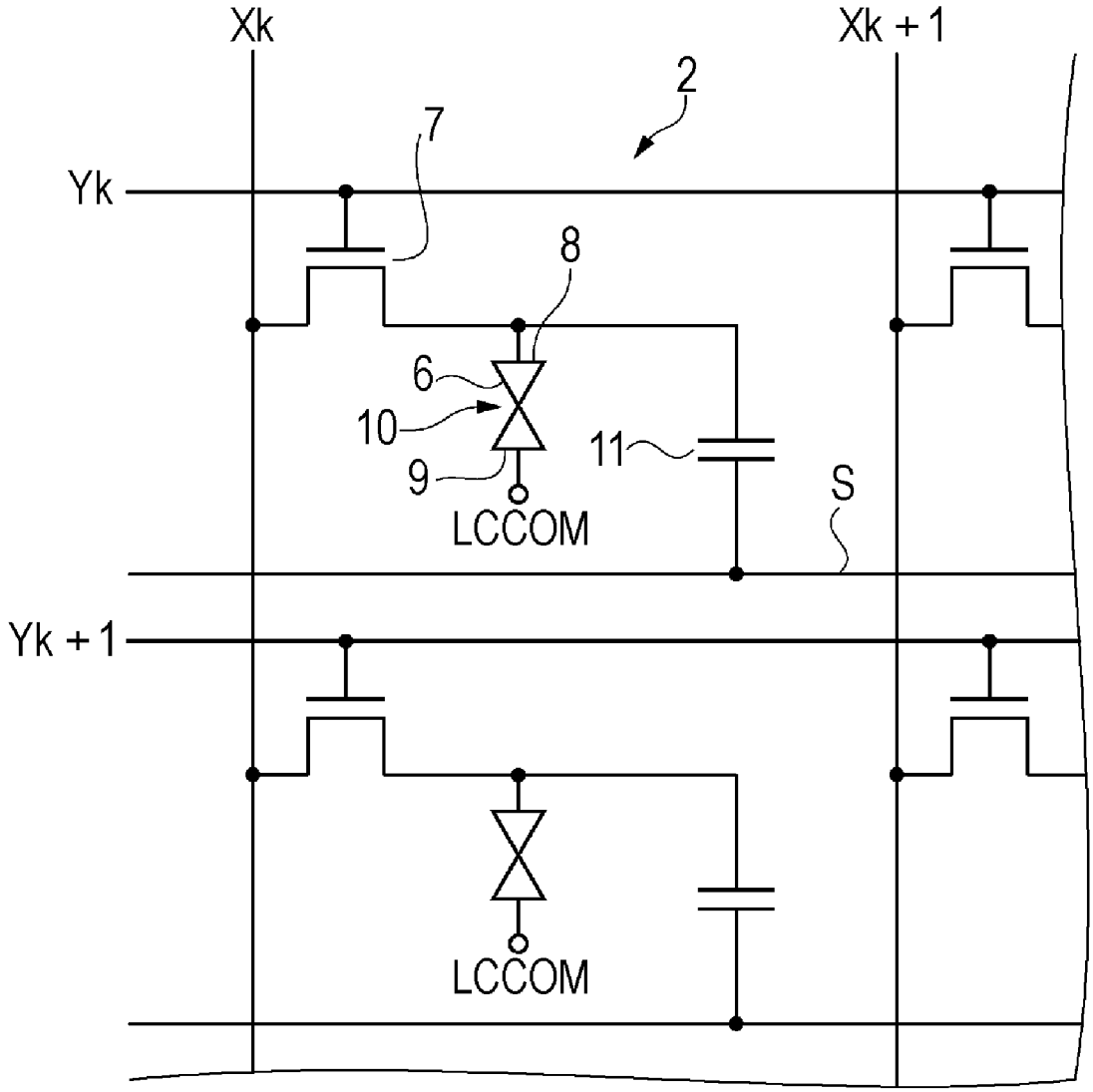
FIG. 2 is a circuit diagram of a pixel in a liquid crystal panel.

FIG. 1 is a block diagram illustrating a driving circuit of a liquid crystal display apparatus, and FIG. 2 is a diagram illustrating an electric analogous circuit (pixel circuit) of a liquid crystal panel.

An outline of the liquid crystal display apparatus according to the first embodiment will now be described based on FIGS. 1 and 2.

Outline of Liquid Crystal Display Apparatus

A liquid crystal display apparatus 100 according to the first embodiment is a three-terminal active matrix liquid crystal display apparatus that employs three-terminal switching elements such as thin-film transistors (TFTs), and the display mode thereof is, for example, the normally white mode.

The subfield driving method, which drives the multiple pixels arranged as a matrix through time division using a binary data signal, is employed in the liquid crystal display apparatus 100. To be more specific, when an image signal supplied to the electrodes of the multiple pixels is written at the frame level, each frame of the image signal is divided into multiple subfields that are shorter than a single frame period, and a frame's worth of an image is then displayed by turning the pixels on or off based on the tone level of the image signal in each subfield. This on/off binary data signal is supplied to each pixel, via switching elements in the pixels, as a positive-polarity data signal, or as a negative-polarity data signal obtained by inverting the positive-polarity data signal.

In particular, in the driving method of this embodiment, a driving method in which the positive-negative polarity data signals are written alternately in cycles is employed.

The liquid crystal display apparatus 100 is configured of a liquid crystal panel 1, a control circuit 5, and so on. The liquid crystal panel 1, serving as a display panel, includes an element substrate and an opposing substrate (not shown), and is configured so that twisted nematic (TN)-type liquid crystals 6 (see FIG. 2) are confined between the two substrates as a liquid crystal layer. The liquid crystal panel 1 also includes a scanning line driving circuit 3 and a data line driving circuit 4.

A display region in which multiple pixels 2 are disposed in an m-row by n-column matrix is formed in the liquid crystal panel 1.

To be more specific, the multiple pixels 2 are disposed in matrix form, corresponding to intersections of scanning lines Y1 to Ym in the m rows and crossing data lines X1 to Xn in the n columns. Each pixel 2 is provided with a TFT (thin film transistor) 7 as a switching element.

As shown in FIGS. 1 and 2, the gate terminals of the TFTs 7 in the pixels 2 are connected to the scanning lines Y1 to Ym, respectively, and the source terminals are connected to the data lines X1 to Xn, respectively; meanwhile, the drain terminals are connected to pixel electrodes 8 in each corresponding pixel 2.

The pixel electrode 8 in the pixel 2 is, as shown in FIG. 2, disposed opposite to a counter electrode 9, provided on the side of the opposing substrate, via the liquid crystal 6. To rephrase, the counter electrodes 9 are formed opposing the multiple pixel electrodes 8 via the liquid crystals 6. The potential of the counter electrode 9 (a counter electrode potential LCCOM) is held at a constant voltage.

Each pixel 2 also includes a liquid crystal capacitor 10 formed by the liquid crystal 6 between the rectangular pixel electrode 8 and the counter electrode 9, and a storage capacitor 11, connected in parallel with the liquid crystal capacitor 10, and serving as a capacitance element (a capacitor) for reducing leaks in the liquid crystal capacitor.

One end of the storage capacitor 11 is connected to the drain terminal of the TFT 7 and the pixel electrode 8, and the other end is connected to a capacitor line S. The potential of the capacitor line S is set to a ground potential, the counter electrode potential LCCOM, or the like.

Next, the electrical configuration of the driving circuit that drives the liquid crystal panel 1 of the liquid crystal display apparatus 100 will be described.

The liquid crystal panel 1 includes two scanning line driving circuits 3 (right and left) for driving the scanning lines Y1 to Ym, and the data line driving circuit 4 for driving the data lines X1 to Xn. The two scanning line driving circuits 3 are identical circuits, and two are provided so that when a single scanning line is selected, all the TFTs 7 connected to that scanning line are collectively selected. In other words, if a scanning line driving circuit has the driving capabilities to collectively select all the TFTs 7 connected to a scanning line, it is possible to use only one scanning line driving circuit.

The control circuit 5 is a CPU (central processing unit), an image processor provided with an internal storage unit, or the like, and controls the driving of the scanning line driving circuit 3 and the data line driving circuit 4. The control circuit 5 is inputted with an image signal Vin, a vertical synchronization signal VSYNC, a horizontal synchronization signal HSYNC, a reference clock CLK, and so on from an external apparatus (not shown). The control circuit 5 generates various timing signals from these inputted signals and supplies the generated signals to the scanning line driving circuit 3 and the data line driving circuit 4. Furthermore, the control circuit 5 converts an image expressed by a single frame's worth of the image signal Vin into a binary value based on the number of subfields, and supplies the resultant thereof to the data line driving circuit 4 as a data signal SV for turning each subfield on/off. Note that the storage unit provided within the control circuit 5 includes a frame memory that holds several frames, a non-volatile memory, or the like. Multiple driving programs specifying the sequence and content of processing for executing the driving method mentioned later, data tables belonging thereto, and so on are stored in the non-volatile memory.

Various timing signals including the vertical synchronization signal VSYNC, a clock signal CLY, and a start signal DY are supplied to the scanning line driving circuit 3 from the control circuit 5 via a data line 13.

The horizontal synchronization signal HSYNC, clock signal CLY, data signal SV, and various timing signals are supplied to the data line driving circuit 4 from the control circuit 5 via a data line 14. Note that an input element into which these various signals are inputted is formed in the element substrate (not shown). Meanwhile, the scanning line driving circuit 3 and data line driving circuit 4 may be provided therein. These driving circuits write positive-polarity data signals and negative-polarity data signals into the pixels 2 by inverting the potential of the data signal SV between higher and lower voltages than the counter electrode potential LCCOM.

Figure 3:
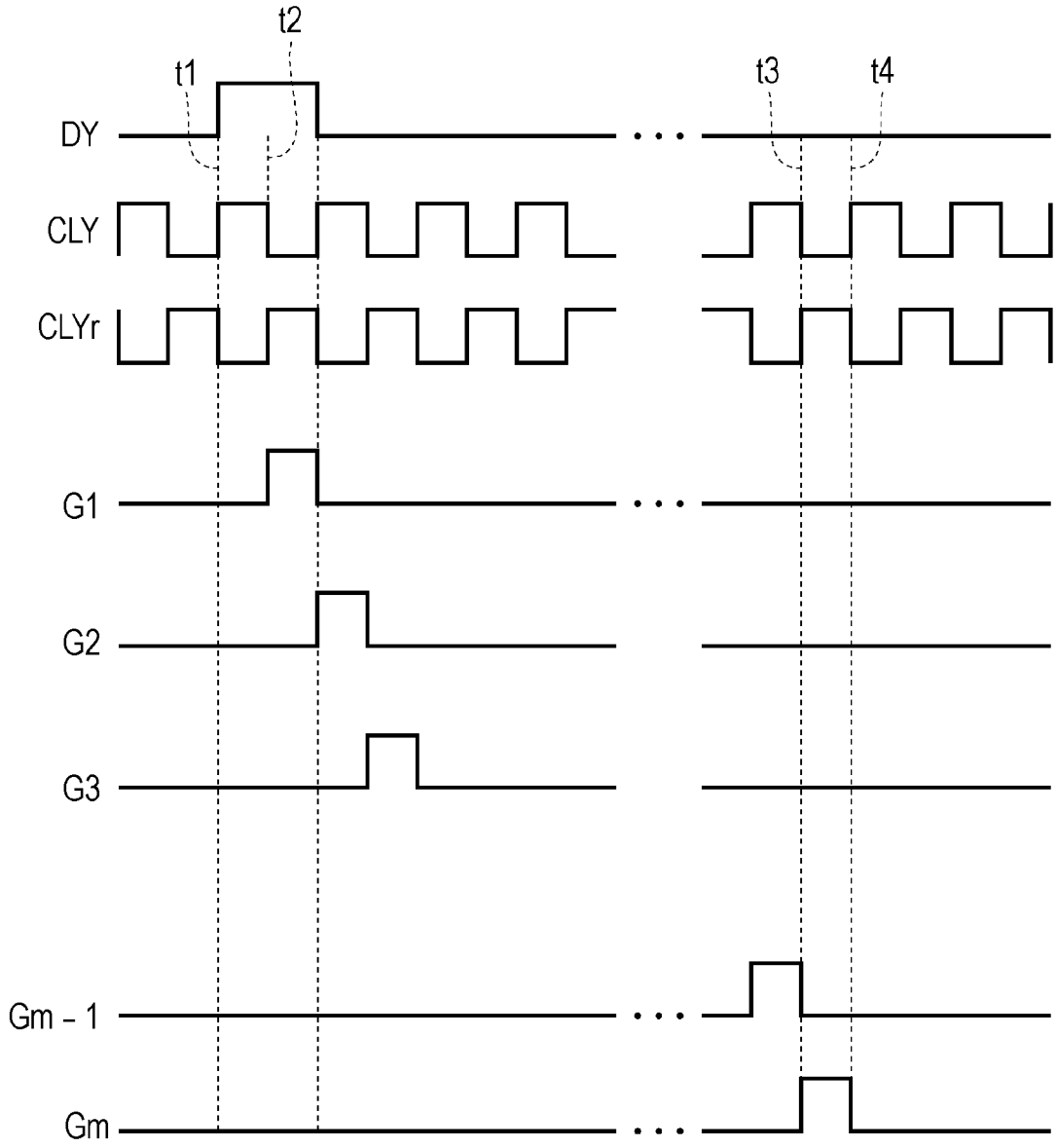
FIG. 3 is a timing chart for a scanning line driving circuit.

FIG. 3 is a timing chart for the vertical line driving circuit.

As shown in FIG. 3, the scanning line driving circuit 3 generates scanning signals G1 to Gm in order and sequentially outputs those signals to the scanning lines Y1 to Ym, based on the start signal DY that serves as a trigger for selecting the scanning lines Y1 to Ym in order, and based on the clock signal CLY (and an inverse clock signal CLYr). Note that the start signal DY is a start pulse that defines the starting timing of vertical scans, and is supplied in each subfield period.

When the scanning lines Y1 to Ym are sequentially selected and the scanning signals G1 to Gm are supplied to the respective lines, all the TFTs 7 connected to the scanning lines enter an on state.

Using the start signal DY at timing t1 as a trigger, the scanning line driving circuit 3 sequentially generates and outputs the scanning signals G1 to Gm during the period from timing t2 to timing t3, thereby selecting the scanning lines Y1 to Ym in order. Then, when the selection period for the scanning signal Gm ends at timing t4, the same scanning driving is repeated for the following subfield. The data line driving circuit 4 is provided with a shift register (not shown) for outputting, in order, data signals of polarities according to an inverting signal (FR) (mentioned later), in a single horizontal scanning period in which the scanning lines Y1 to Ym are selected in order. Note that because the inverting signal is constant within a single subfield period, the polarity of the data signal within a single vertical scanning period is either positive polarity or negative polarity. Note also that in the following descriptions, the "subfield period" is also sometimes referred to simply as a "subfield".

Driving Method

Figure 4:
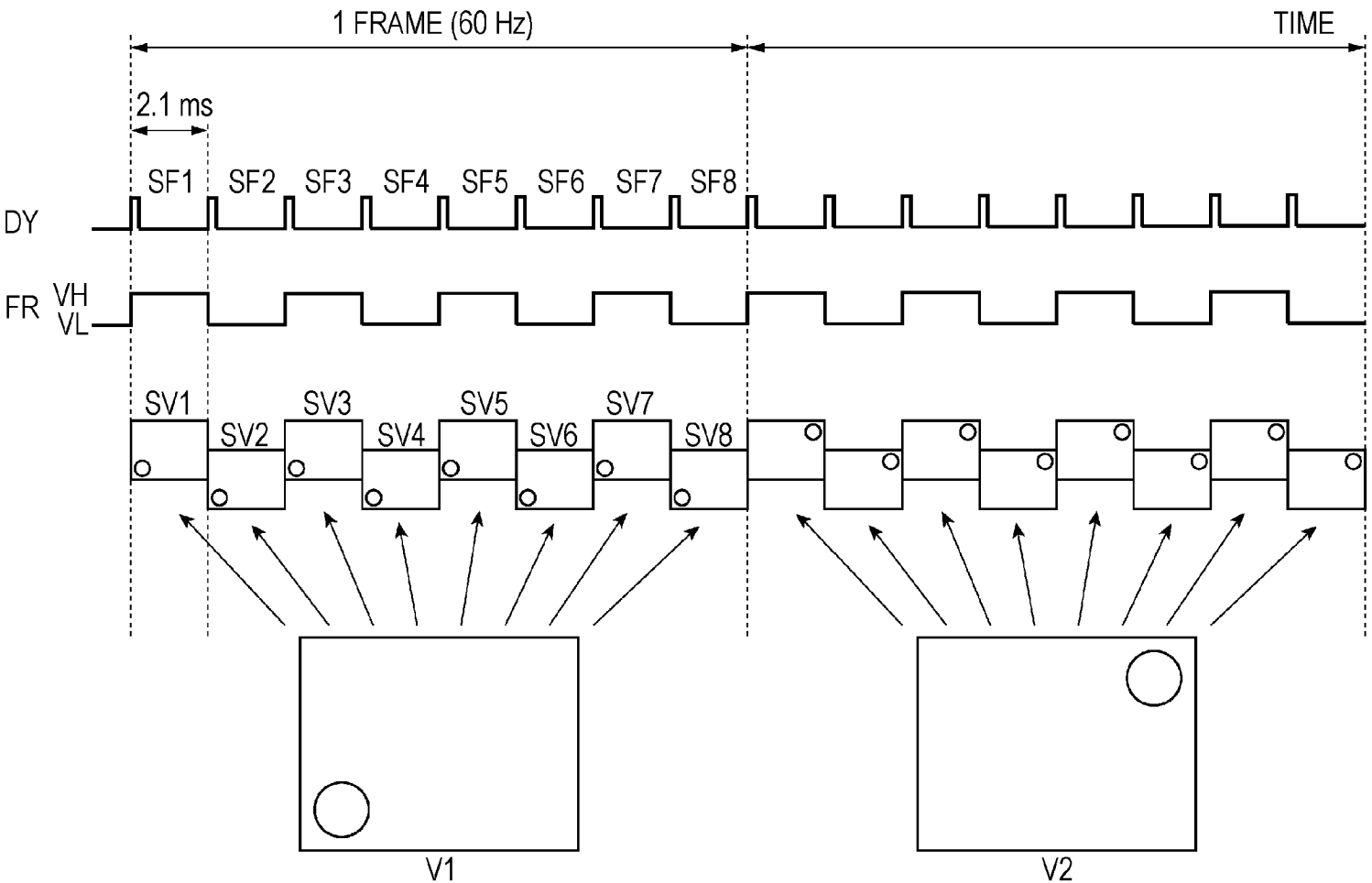
FIG. 4 is a timing chart for a driving method.

FIG. 4 is a timing chart for the driving method according to this embodiment. Note that the following descriptions will be given assuming that the vertical synchronization signal VSYNC (see FIG. 1) has a frequency of 60 Hz (a cycle of approximately 16.7 ms). In other words, the following descriptions assume that the image framerate is 60 fps.

FIG. 4 shows a timing chart for the start signal DY and the inverting signal FR, and also schematically illustrates an image of the data signals supplied in each subfield.

In this embodiment, a single frame is divided into eight subfields (SF1 to SF8), and the vertical scanning driving illustrated in FIG. 3 is carried out in each subfield. Specifically, with each start pulse, or start signal DY, supplied eight times in a single frame, a single vertical scan is performed and a data signal is applied to all pixels. The supply timing of the start pulse is once every period obtained by dividing the period length of a single frame into eight parts (approximately 2.1 ms).

The inverting signal FR is a timing signal that defines the polarity of the data signal, and is a signal that repeatedly cycles between a high potential VH and a low potential VL. The frequency of the inverting signal FR is set to 240 Hz (a cycle of approximately 4.2 ms), and the period length of the half-cycle thereof is in synchronization with the supply timing of the start pulse.

When the inverting signal FR is at the high potential VH, the control circuit 5 (see FIG. 1) generates a data signal having a voltage higher than the counter electrode potential LCCOM (a positive-polarity voltage), and transmits this data signal to the data line driving circuit 4. On the other hand, when the inverting signal FR is at the low potential VL, the control circuit 5 generates a data signal having a voltage lower than the counter electrode potential LCCOM (a negative-polarity voltage), and transmits this data signal to the data line driving circuit 4. In other words, because the inverting signal FR half-cycle is in synchronization with the start timing of each subfield, data signals of positive-polarity voltages and negative-polarity voltages are alternately written into the pixels in continuous subfields. To rephrase, a positive-polarity data signal is supplied in odd-numbered subfields, while a negative-polarity data signal is supplied in even-numbered subfields.

Note that in FIG. 1, if the image expressed in a single frame of the image signal Vin supplied to the control circuit 5 from an external apparatus is taken as an image V1, data signals SV1 to SV8 obtained by dividing the image V1 into eight subfields are written. Specifically, the data signals SV1 to SV8 define the image V1 by binary numbers based on the tone of each pixel and the number of subfields, and are generated by the control circuit 5 as on/off binary data signals, and are then supplied to the data line driving circuit 4.

In other words, the image V1 is displayed by binary data signal writes (vertical scans) for eight continuous subfields.

Likewise, for the second frame, which follows the first frame, data signals for each of eight subfields defining an image V2 of the second frame are written as alternating data signals of positive-polarity and negative-polarity in accordance with the inverting signal FR. The same applies to the frames thereafter.

Although a case in which a single frame is divided into eight equal portions (8-SF driving) has been described thus far, results of experiments performed by the inventors demonstrated that any number of divisions between four and ten may be employed. To rephrase, it is preferable for half of the period length in a single inverting signal FR cycle to be greater than or equal to 1.6 ms, and further preferable for that half-length to be between 1.6 ms and 4.2 ms.

To be more specific, with four divisions, the start signal DY start pulse is supplied four times in a single frame, and the supply timing thereof is every period length obtained by dividing the period length of a single frame by four (approximately 4.2 ms). In this case, the frequency of the inverting signal FR is 120 Hz (a cycle of approximately 8.3 ms). Meanwhile, with six divisions, the start signal DY start pulse is supplied six times in a single frame, and the supply timing thereof is every period length obtained by dividing the period length of a single frame by six (approximately 2.8 ms). In this case, the frequency of the inverting signal FR is 180 Hz (a cycle of approximately 5.6 ms). Finally, with ten divisions, the start signal DY start pulse is supplied ten times in a single frame, and the supply timing thereof is every period length obtained by dividing the period length of a single frame by ten (approximately 1.7 ms). In this case, the frequency of the inverting signal FR is 300 Hz (a cycle of approximately 3.3 ms). Note that when changing the number of divisions, the data signals in the control circuit 5 are also generated as data signals based on that number of divisions.

As described thus far, the liquid crystal display apparatus 100 of this embodiment can achieve the following effects.

According to this driving method, polarity inversion is performed at a faster cycle than the image framerate and within a range in which the liquid crystals can respond, and thus the symmetry of the applied positive-polarity and negative-polarity voltages can be optimized better than in the past. To rephrase, by making the period length of the inverting signal FR half-cycle near or greater than the liquid crystal response time, the adsorption of impurity ions can be suppressed more than with past driving methods, in which the polarity inversion cycle has been too short relative to the liquid crystal response time. Thus the symmetry of the voltages applied to the liquid crystal layer can be improved, making it possible to suppress the image problem known as flicker and suppress degradation in the liquid crystal material due to the application of DC voltages. In other words, it is possible not only to suppress the production of impurity ions, but also to reduce the adsorption of impurity ions.

The driving method that employs eight divisions illustrated in FIG. 4 has particularly good balance between the suppression of impurity ion adsorption and the expression of rich tones, more so than when employing four or ten divisions. According to the results of experiments performed by the inventors, the effect of suppressing the adsorption of impurity ions was achieved through subfield driving in which polarity inversion was executed for two cycles or more within a single frame (four divisions). This effect was more marked when the inversion was performed for four cycles within a single frame (eight divisions). This is because accelerating the positive-negative polarity inversion cycle is effective in suppressing the movement of impurity ions toward the substrate, or in other words, suppressing impurity ions from collecting as they are produced.

Furthermore, with subfield driving, increasing the number of subfields (the number of divisions) is effective for displaying an image expressed by an image signal in a more rich manner. This is because increasing the number of divisions increases the limit of resolution, and in turn increases the number of tones that can be expressed. On the other hand, the results of the aforementioned experiments indicated that it is difficult to obtain the desired effects if the polarity inversion exceeds five cycles (ten divisions). This is thought to be because these effects depend on the response time of the liquid crystals, as mentioned before, and thus with more than five cycles, the polarity inversion cycle half-length is too short relative to the liquid crystal response time, rendering the liquid crystals unable to keep pace, and making sufficient polarity inversion impossible. This can, in other words, be considered to be a state in which the polarity inversion is not transmitted to the impurity ions within the liquid crystals as well. Note that the impurity ion adsorption suppression effects have been confirmed up to five cycles (ten divisions). This is thought to be because while the half-cycle period length (1.67 ms) is insufficient for the liquid crystal response time, it is near that response time, and thus the liquid crystals can essentially keep pace up to this period length.

It can therefore be said that a driving method employing eight divisions has the best balance between the suppression of impurity ion adsorption and the expression of rich tones.

Accordingly, with the driving method according to this embodiment, display deficiencies caused by impurity ions can be suppressed. An image having rich tone expression can also be displayed.

Furthermore, with the liquid crystal display apparatus 100, display deficiencies caused by impurity ions can be suppressed. An image having rich tone expression can also be displayed.

Second Embodiment

Figure 5:
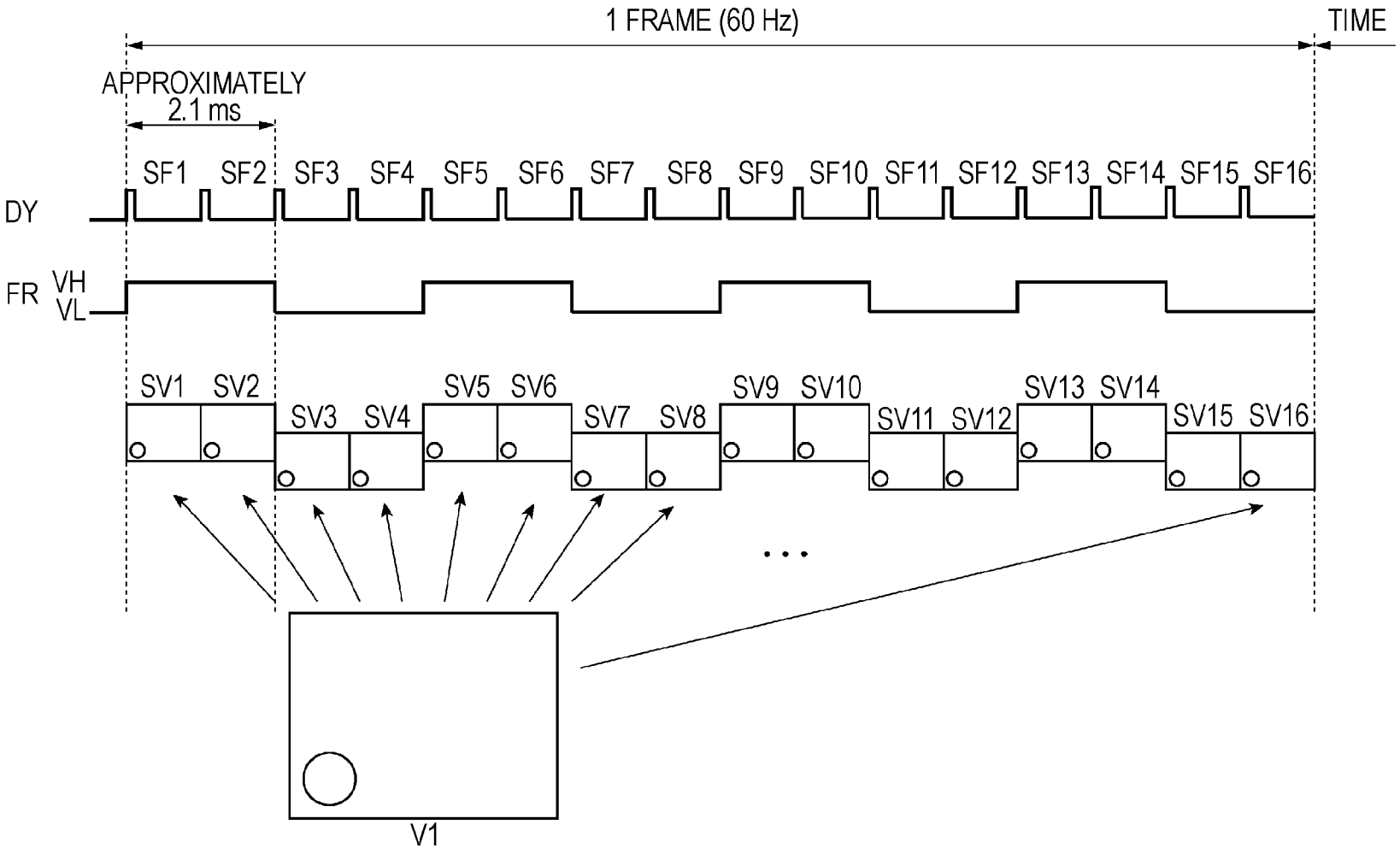
FIG. 5 is a timing chart for a driving method according to a second embodiment.

FIG. 5 is a timing chart for a driving method according to a second embodiment, and corresponds to that shown in FIG. 4. The driving method according to the second embodiment of the invention will be described hereinafter.

The driving method of the second embodiment differs from the driving method shown in FIG. 4 in that multiple subfield periods are provided within the inverting signal FR half-cycle. Note that the liquid crystal display apparatus that employs this driving method is the liquid crystal display apparatus 100 described in the first embodiment, and a driving program that specifies that driving method is stored within the non-volatile memory of the control circuit 5.

Hereinafter, elements that are the same as those described in the first embodiment will be given the same reference numerals, and descriptions thereof will be omitted.

With the driving method of this embodiment, a single frame is divided into 16 subfields, and the vertical scanning driving illustrated in FIG. 3 is carried out in each subfield. The supply timing of the start pulse is once every period obtained by dividing the period length of a single frame into 16 parts (approximately 1.0 ms). Meanwhile, assuming that the image expressed in a single frame of the image signal Vin is taken as an image V1, data signals SV1 to SV16 obtained by dividing the image V1 into 16 subfields are generated in the control circuit 5 (see FIG. 1), and are supplied to the data line driving circuit 4.

Aside from the above, the configuration and timing are the same as those described in the first embodiment. Note that although only a single frame is illustrated in FIG. 5 for explanatory purposes, in actuality, similar frames continue in time series.

As in the timing chart shown in FIG. 4, the frequency of the inverting signal FR here is 240 Hz (a cycle of approximately 4.2 ms), and thus two subfields of equal period lengths are formed within the period length of the polarity inversion cycle half-cycle.

Furthermore, the polarities of the data signals written in each subfield alternate between positive and negative polarities with each polarity inversion cycle half-cycle. In other words, positive-polarity data signals SV1 and SV2 are written in the subfields SF1 and SF2, whereas negative-polarity data signals SV3 and SV4 are written in the following subfields SF3 and SF4. To rephrase, a positive-polarity data signal and a negative-polarity data signal are alternately written into two consecutive subfields, in synchronization with the inversion cycle of the inverting signal FR.

In this manner, the image V1 is displayed by binary data signal writes (vertical scans) for 16 continuous subfields.

Note that the number of divisions for the subfields may be any number as long as the frequency of the inverting signal FR is the same. This is because the polarity of the data signal is synchronized with the polarity inversion of the inverting signal regardless of the number of subfields. For example, the configuration may employ 24 divisions, 32 divisions, or the like.

Moreover, the frequency of the inverting signal FR is not limited to 240 Hz, and any frequency within the range of 120 Hz to 300 Hz is acceptable. This range is obtained by replacing the permissible number of divisions (the range between four and ten divisions) described in the first embodiment with the inverting signal FR.

Furthermore, as described above, the number of divisions for the subfields may be any number regardless of the frequency of the inverting signal FR within the range described here.

As described thus far, the display apparatus according to this embodiment can achieve the following effects in addition to the effects of the first embodiment.

According to the driving method of the second embodiment, the polarity inversion is performed for four cycles within a single frame, thus making it possible to suppress impurity ion adsorption. Furthermore, because two subfields are provided within the polarity inversion cycle half-cycle, or in other words, a single frame is divided into 16 portions, a higher limit of resolution and a richer display with a higher number of tones can be achieved.

Third Embodiment

Figure 6:
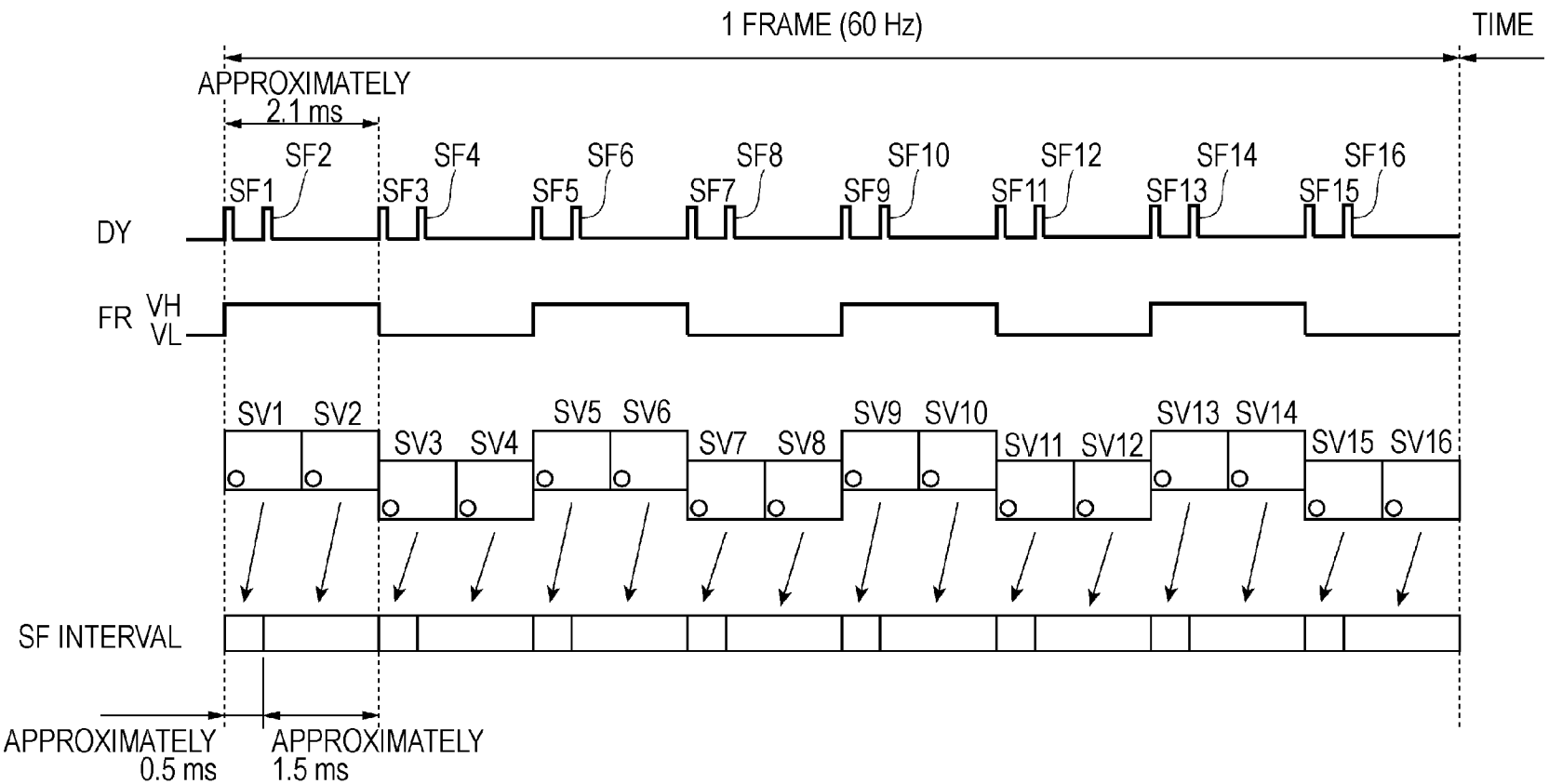
FIG. 6 is a timing chart for a driving method according to a third embodiment.

FIG. 6 is a timing chart for a driving method according to a third embodiment, and corresponds to that shown in FIG. 5. The driving method according to the third embodiment of the invention will be described hereinafter.

The driving method of the third embodiment differs from the driving method illustrated in FIG. 5 in that the period lengths of the multiple subfields provided within the inverting signal FR half-cycle are different. Note that the liquid crystal display apparatus that employs this driving method is the liquid crystal display apparatus 100 described in the first embodiment, and a driving program that specifies that driving method is stored within the non-volatile memory of the control circuit 5.

Hereinafter, elements that are the same as those described in the first and second embodiments will be given the same reference numerals, and descriptions thereof will be omitted.

With the driving method of this embodiment, a single frame is divided into 16 subfields, and the vertical scanning driving illustrated in FIG. 3 is carried out in each subfield. The start pulse is supplied twice in an period length obtained by dividing the period length of a single frame into 8 equal parts (approximately 2.1 ms), once at the starting timing thereof, and again after approximately 0.6 ms has elapsed from the starting timing. In other words, instead of all of the subfield periods being the same period, weighting processes with different periods are performed for each subfield.

Aside from the above, the configuration and timing are the same as those described in the second embodiment. Note that although only a single frame is illustrated in FIG. 6 for explanatory purposes, in actuality, similar frames continue in time series.

With this driving method, when a data signal supplied to the electrodes of the multiple pixels is written at the frame level, each frame of the image signal is divided into subfields that are shorter than a single frame period, and a frame's worth of an image V1 is then displayed by applying binary data signals SV1 to SV16 to the pixels depending on the tone level of the image V1 expressed by a single frame's worth of the image signal Vin. Note that although the image V1 is not illustrated in FIG. 6, the same image V1 as that of FIG. 5 is displayed by the continuous data signals SV1 to SV16.

Meanwhile, the subfield weighting is set to be different for odd-numbered subfields and even-numbered subfields, so that the period of odd-numbered subfields is 0.6 ms, whereas the period of even-numbered subfields is 1.5 ms.

As in the timing chart shown in FIG. 5, the frequency of the inverting signal FR here is 240 Hz (a cycle of approximately 4.2 ms), and thus two subfields of different period lengths are formed within the period length of the polarity inversion cycle half-cycle.

Furthermore, the polarities of the data signals written in each subfield alternate between positive and negative polarities with each polarity inversion cycle half-cycle. In other words, positive-polarity data signals SV1 and SV2 are written in the subfields SF1 and SF2, whereas negative-polarity data signals SV3 and SV4 are written in the following subfields SF3 and SF4. To rephrase, a positive-polarity data signal and a negative-polarity data signal are alternately written into every two consecutive subfields, in synchronization with the inversion cycle of the inverting signal FR.

In this manner, the image V1 is displayed by binary data signal writes (vertical scans) for 16 continuous subfields.

Note that any combination of subfield weightings may be employed as long as the period length of the polarity inversion cycle half-cycle of the inverting signal FR and the total of the period lengths of the multiple subfields are set to be equal. For example, the period of the odd-numbered subfields may be 1.3 ms, and the period of the even-numbered subfields may be 0.8 ms.

Moreover, the frequency of the inverting signal FR is not limited to 240 Hz, and any frequency within the range of 120 Hz to 300 Hz is acceptable. Furthermore, with respect to the frequency of the inverting signal FR, the period lengths of the multiple subfields may, as described above, be set to any combination as long as the period length of the polarity inversion cycle half-cycle and the total of the period lengths of the multiple subfields are equal.

As described thus far, the display apparatus according to this embodiment can achieve the following effects in addition to the effects of the first and second embodiments.

According to the driving method of the third embodiment, the polarity inversion is performed for four cycles within a single frame, thus making it possible to suppress impurity ion adsorption. Furthermore, in addition to dividing a single frame into 16 portions, weighting is performed so that the period lengths are different for odd-numbered subfields and even-numbered subfields, a higher limit of resolution and a richer display with a higher number of tones can be achieved.

Electronic Device

Figure 7:
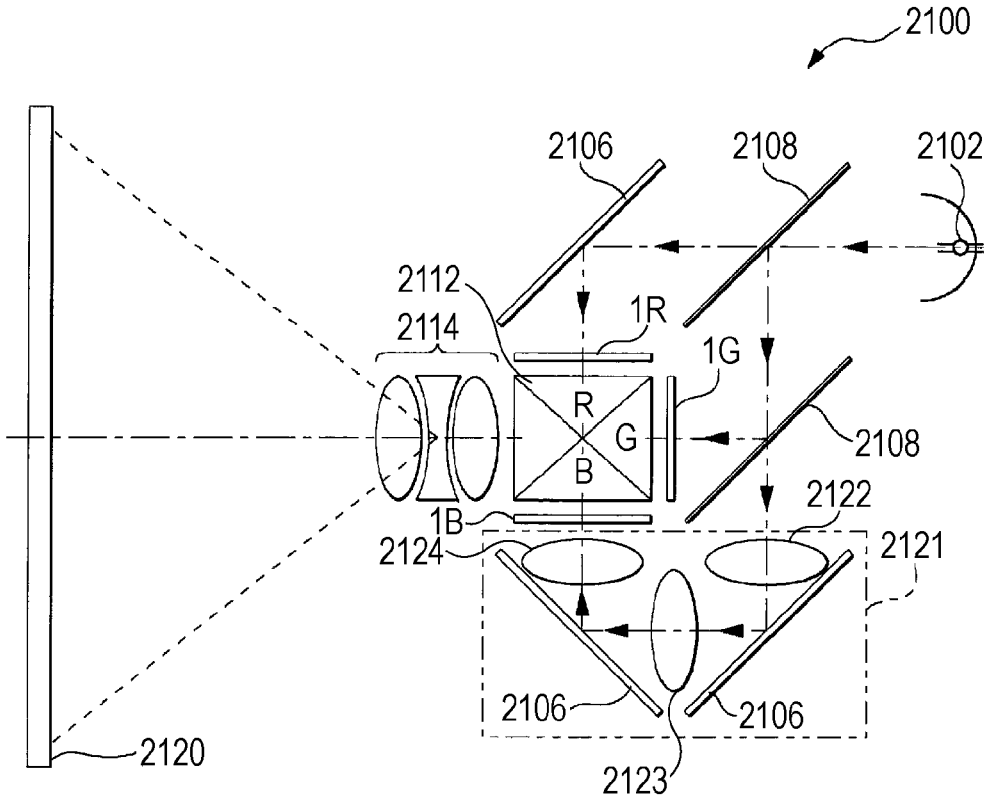
FIG. 7 is a diagram illustrating the overall configuration of a projector serving as an electronic device.

FIG. 7 is a diagram showing the overall configuration of a three-panel projector serving as an electronic device that uses the aforementioned liquid crystal display apparatus as its light bulbs.

Here, an electronic device that employs the liquid crystal display apparatus 100 (liquid crystal panel 1) according to the aforementioned embodiments will be described as an example.

A projector 2100 serving as an electronic device is a three-panel liquid crystal projector in which light emitted from a light source unit 2102 is split into red (R), green (G), and blue (B) lights, after which three liquid crystal panels 1 for red (R), green (G), and blue (B) are used as light bulbs 1R, 1G, and 1B. Note that although the control circuit 5 (see FIG. 1) is not shown as part of the configuration in FIG. 7, the control circuit 5 is realized by a single control circuit that collectively drives the three light bulbs. With respect to the driving method, it is assumed that one of the driving methods described in the aforementioned embodiments and the following variation is employed.

With the projector 2100, the light that is to enter the light bulbs 1R, 1G, and 1B is split into the three colors R (red), G (green), and B (blue) by three mirrors 2106 and two dichroic mirrors 2108 disposed within the projector 2100; the respective lights are then guided into their corresponding light bulbs 1R, 1G, and 1B. Note that because the blue light has a longer optical path than the red and green lights, the blue light is guided through a relay lens system 2121 configured of an incoming lens 2122, a relay lens 2123, and an outgoing lens 2124 to prevent loss of light.

The configurations of the light bulbs 1R, 1G, and 1B are the same as the liquid crystal panels 1 of the aforementioned embodiments, and display image signals corresponding to the R, G, and B colors, respectively, supplied from an external host device (not shown).

The lights modulated by the light bulbs 1R, 1G, and 1B enter a dichroic prism 2112 from three directions. While the R and B lights are refracted 90 degrees by the dichroic prism 2112, the G light advances directly.

The light combined by the dichroic prism 2112 to express a color image is enlarged and projected by a lens unit 2114, and a full-color image is displayed upon a screen 2120 as a result.

Note that while translucent images from the light bulbs 1R and 1B are projected after first being reflected by the dichroic prism 2112, a translucent image from the light bulb 1G is projected directly, and thus the image formed by the light bulbs 1R and 1B and the image formed by the light bulb 1G are set so as to be inverted horizontally relative to each other.

In addition to the device illustrated in FIG. 7, a rear-projection television, a direct-view monitor such as that used in a mobile telephone, a personal computer, a video camera monitor, a car navigation system, a pager, a Personal Digital Assistant, a calculator, a word processor, a workstation, a videophone, a POS terminal, a digital still camera, a touch panel-equipped device, and so on can be given as examples of the electronic device. The liquid crystal display apparatus according to the invention can be applied to other electronic devices as well.

Note also that the invention is not limited to the embodiments described above, and many variations and alterations thereof are possible as well. One such variation will be described hereinafter.

Variation

Although the aforementioned embodiments describe a dot-sequential configuration in which data signals are written sequentially into the data lines X1 to Xn for pixels along a single scanning line Y, a configuration that also uses so-called phase expansion driving (also called "serial-parallel conversion"), whereby the data signals are extended m times (where m is an integer of 2 or more) in the time axis and are supplied to m image data lines, may be employed (see JP-A-2000-112437).

Alternatively, a so-called line-sequential configuration may be employed, whereby data signals are supplied to all the data lines X1 to Xn at once.

The same effects described in the various embodiments can be obtained using these driving methods as well. Furthermore, although the aforementioned embodiments discuss the application of a normal white mode, in which white is displayed when no voltage is applied, as the liquid crystal mode, a normal black mode, in which black is displayed when no voltage is applied, can be employed instead.

The entire disclosure of Japanese Patent Application No. 2009-033606, filed Feb. 17, 2009 is expressly incorporated by reference herein.

What is claimed is:

1. A driving method for a liquid crystal display apparatus that includes a liquid crystal panel having a switching element and a pixel electrode provided corresponding to an intersecting point between a scanning line and a data line, a counter electrode provided facing the pixel electrode, and a liquid crystal layer sandwiched between the pixel electrode and the counter electrode, the driving method comprising:

controlling the transmitted light in the liquid crystal layer by dividing a single frame period into multiple subfield periods and applying an on/off binary data signal between the pixel electrode and the counter electrode in each subfield period, converting the data signal to the positive-polarity voltage and negative-polarity voltage alternately and cyclically every a cyclical period having subfield period or several subfield periods when a counter electrode potential applied to the counter electrode is used as a reference and a voltage higher than the reference is taken as a positive-polarity voltage and a voltage lower than the reference is taken as a negative-polarity voltage, and the length of half the cyclical period is no less than 1.6 ms.

2. The driving method for a liquid crystal display apparatus according to claim 1, wherein the length of half the cyclical period is no less than 1.6 ms and no more than 4.2 ms.

3. The driving method for a liquid crystal display apparatus according to claim 1, wherein the subfield periods within a single frame period are not all the same, and subfield periods of different lengths are contained in the single frame period.

4. A liquid crystal display apparatus comprising:

a liquid crystal panel having a switching element and a pixel electrode provided corresponding to an intersecting point between a scanning line and a data line, a counter electrode provided facing the pixel electrode, a liquid crystal layer sandwiched between the pixel electrode and the counter electrode, and, a control circuit controlling the transmitted light in the liquid crystal layer by dividing a single frame period into multiple subfield periods and applying an on/off binary data signal between the pixel electrode and the counter electrode in each subfield period; when a counter electrode potential applied to the counter electrode is used as a reference and a voltage higher than the reference is taken as a positive-polarity voltage and a voltage lower than the reference is taken as a negative-polarity voltage, the data signal is converted to the positive-polarity voltage and negative-polarity voltage alternately and cyclically every a cyclical period having subfield period or several subfield periods, and the length of half the cyclical period is no less than 1.6 ms.

5. The liquid crystal display apparatus according to claim 4, wherein the length of half the cyclical period is no less than 1.6 ms and no more than 4.2 ms.

6. An electronic device comprising the liquid crystal display apparatus according to claim 4.

* * * * *